US009351570B2

(12) United States Patent
Koefelda et al.

(10) Patent No.: US 9,351,570 B2
(45) Date of Patent: May 31, 2016

(54) TUB AND TRAY ASSEMBLY

(75) Inventors: Gerald R. Koefelda, Rowlett, TX (US); Ryan C. Meers, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 1418 days.

(21) Appl. No.: 11/499,251

(22) Filed: Aug. 4, 2006

(65) Prior Publication Data

US 2008/0029422 A1 Feb. 7, 2008

(51) Int. Cl.
*A47B 88/04* (2006.01)
*A47B 55/00* (2006.01)

(52) U.S. Cl.
CPC ..... *A47B 88/0455* (2013.01); *A47B 55/00* (2013.01)

(58) Field of Classification Search
CPC ..... A47B 88/0455; A47B 55/00
USPC ..... 206/515, 509, 564, 560, 514, 501, 502; 220/572, 23.89, 23.87, 628, 630
See application file for complete search history.

(56) References Cited

U.S. PATENT DOCUMENTS

| | | | | | |
|---|---|---|---|---|---|
| 864,556 | A | * | 8/1907 | Reiter | 220/630 |
| 3,327,896 | A | * | 6/1967 | Asenbauer | 206/509 |
| 3,407,429 | A | * | 10/1968 | Di Nardo | 15/257.01 |
| 3,448,888 | A | * | 6/1969 | Collie et al. | 220/781 |
| 3,606,074 | A | * | 9/1971 | Hayes | 220/212 |
| 3,667,647 | A | * | 6/1972 | Van Daalen | 220/23.4 |
| 3,952,903 | A | * | 4/1976 | Sanders et al. | 220/4.24 |
| 3,963,125 | A | | 6/1976 | Baggott | |
| D259,819 | S | * | 7/1981 | Cornou | D3/307 |
| 4,671,411 | A | * | 6/1987 | Rehrig et al. | 206/505 |
| D292,634 | S | * | 11/1987 | Chabot | D3/307 |
| 4,722,442 | A | * | 2/1988 | Smith | 206/515 |
| 4,742,931 | A | * | 5/1988 | Bennett | 220/23.86 |
| 5,011,011 | A | * | 4/1991 | Kidd | 206/319 |
| 5,131,535 | A | * | 7/1992 | O'Connor et al. | 206/722 |
| 5,150,804 | A | * | 9/1992 | Blanchet et al. | 220/212 |
| 5,158,184 | A | * | 10/1992 | Craft et al. | 211/41.3 |
| 5,253,777 | A | * | 10/1993 | Schutz | 220/571 |
| 5,385,261 | A | * | 1/1995 | Lippisch et al. | 220/572 |
| 5,396,989 | A | | 3/1995 | Hein | |
| 5,423,449 | A | * | 6/1995 | Gordon et al. | 220/23.89 |
| 5,429,236 | A | * | 7/1995 | Evans | 206/386 |
| 5,692,617 | A | * | 12/1997 | Adams | 206/508 |

(Continued)

FOREIGN PATENT DOCUMENTS

| | | |
|---|---|---|
| EP | 0 093 180 | 11/1983 |
| EP | 1 473 216 | 11/2004 |

(Continued)

OTHER PUBLICATIONS

United Kingdom Search Report for Application No. GB0715136.8, Apr. 22, 2008.

(Continued)

*Primary Examiner* — Stephen Castellano
(74) *Attorney, Agent, or Firm* — Carlson, Gaskey & Olds PC

(57) ABSTRACT

A storage system includes a tray that can be stored on automated storage and retrieval racks. A tub is removably securable to the tray. The tub includes a bottom wall, a pair of opposed side walls and a pair of opposed end walls. The bottom wall of the tub is removably secured to the tray. Thus, some of the trays in the storage system can be provided with tubs for the storage of loose items.

17 Claims, 15 Drawing Sheets

(56) References Cited

U.S. PATENT DOCUMENTS

| | | | | |
|---|---|---|---|---|
| 5,868,268 | A * | 2/1999 | Walker | 220/379 |
| 5,915,909 | A * | 6/1999 | Smith | 414/280 |
| D421,183 | S * | 2/2000 | Koskinen | D3/312 |
| 6,394,274 | B1 * | 5/2002 | Cheeseman | 206/511 |
| 6,439,418 | B1 * | 8/2002 | Immerman et al. | 220/630 |
| 6,651,836 | B1 | 11/2003 | Hofheins et al. | |
| 6,729,472 | B2 * | 5/2004 | Stucke et al. | 206/515 |
| 6,796,430 | B2 * | 9/2004 | Mercier et al. | 206/505 |
| 7,104,553 | B2 * | 9/2006 | Gruber | 280/33.991 |
| D532,948 | S * | 11/2006 | Gillisie | D32/55 |
| 7,168,905 | B1 * | 1/2007 | Solomon et al. | 414/237 |
| 7,249,686 | B1 * | 7/2007 | Aesquivel | 220/556 |
| 7,329,081 | B2 * | 2/2008 | Baker et al. | 414/626 |
| 2002/0130133 | A1 * | 9/2002 | Immerman et al. | 220/630 |
| 2003/0155363 | A1 * | 8/2003 | Mercier | 220/630 |
| 2003/0205877 | A1 * | 11/2003 | Verna et al. | 280/79.11 |
| 2004/0118742 | A1 * | 6/2004 | Shuert | 206/600 |
| 2005/0133514 | A1 * | 6/2005 | Schutz | 220/630 |
| 2005/0140107 | A1 | 6/2005 | Gruber | |
| 2005/0150804 | A1 * | 7/2005 | Chen | 206/514 |
| 2007/0159040 | A1 | 7/2007 | Fernandez et al. | |

FOREIGN PATENT DOCUMENTS

| | | |
|---|---|---|
| EP | 1 797 795 | 6/2007 |
| GB | 1 189 988 | 4/1970 |
| WO | WO2006/040301 | 4/2006 |

OTHER PUBLICATIONS

United Kingdom Search Report for Application No. GB0715136.8, Apr. 23, 2008.

Examination report mailed Jan. 26, 2011 for GB0715136.8.

* cited by examiner

TUB AND TRAY ASSEMBLY

BACKGROUND OF THE INVENTION

The present invention relates generally to storage systems and containers.

Some automated storage and retrieval systems include racks having rows and columns of shelves provided by pairs of spaced-apart supports or rails. Trays are supported on the rails. Objects are stored on the trays and the trays and objects are stored in the racks. The automated retrieval equipment lifts and retrieves selected trays from the rails when necessary.

SUMMARY OF THE INVENTION

The present invention provides a tray and tub assembly, particularly useful in a storage system. The tray can be used on the known storage and retrieval racks. The tub is removably securable to the tray. The tub includes a bottom wall, a pair of opposed side walls and a pair of opposed end walls. The bottom wall of the tub is removably secured to the tray. Thus, some of the trays in the storage system can be provided with tubs for the storage of loose items.

Because the tub will be connected to and supported by the tray, the tub does not have to be rigid enough to support itself and its load on the spaced-apart rails of the rack. Also, connecting the tubs to the trays provides uniformity in the handling and storage of the trays, i.e. trays with and without tubs can be handled similarly. Because the tub does not need to provide rigid support, the tub need not be reinforced with ribs and can even be thermoformed.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
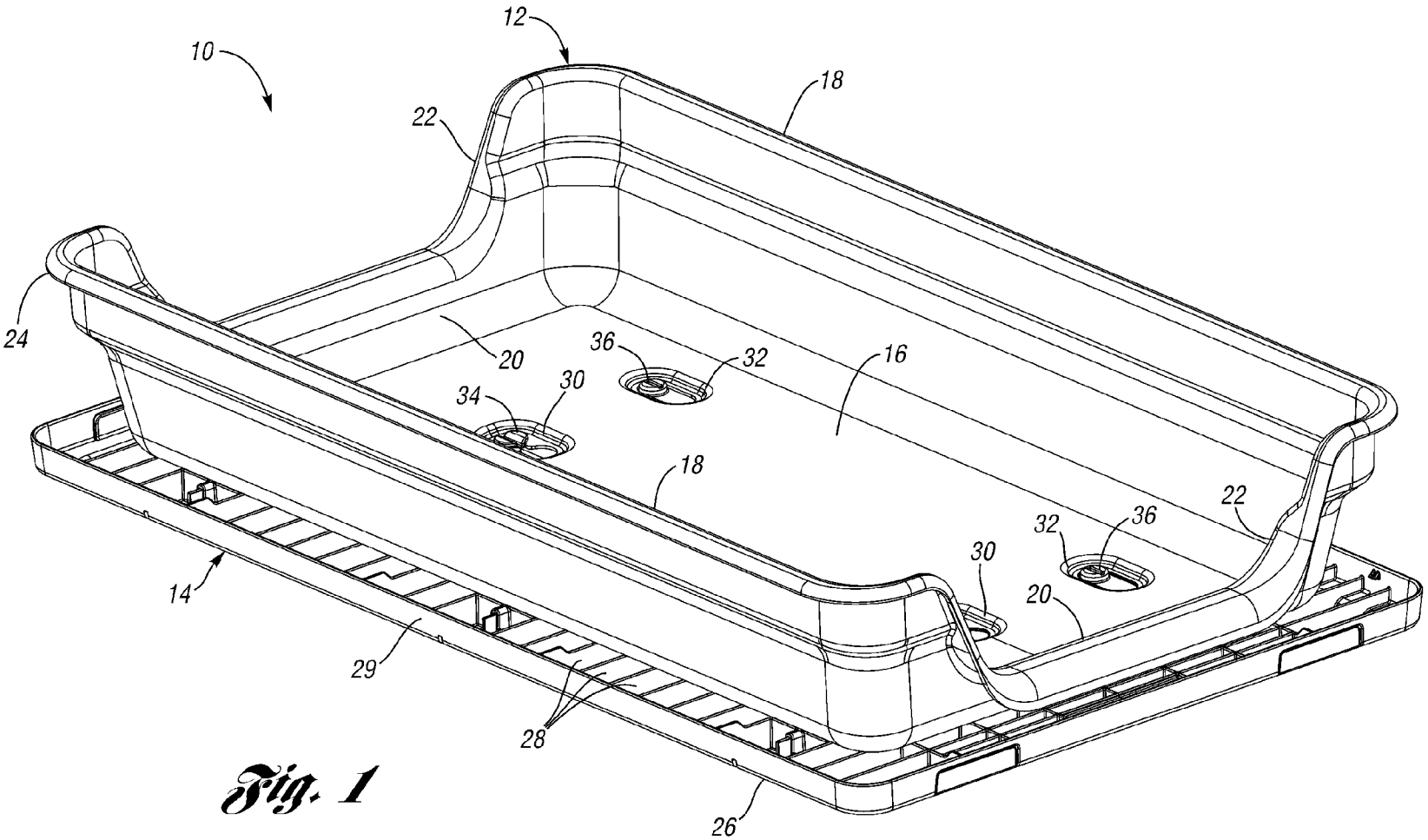
FIG. 1 is a perspective view of a tub and tray storage system according to the present invention.

Referring to FIG. 1, a storage assembly 10 according to one embodiment of the present invention includes a tub 12 supported by and removably secured to a tray 14. The tub 12 includes a bottom wall 16 up from which extend side walls 18 and end walls 20. A lip 24 protrudes outward from the upper edge of the side walls 18 and end walls 20. As shown, the height of the end walls 20 may be significantly less than that of the side walls 18 to define access openings 22. Alternatively, the end walls 20 could be the same height as the side walls 18. The bottom wall includes a plurality of connector openings 30 and alignment openings 32.

The tray 14 includes a bottom wall 26 having a plurality of ribs 28 including a peripheral rib 29 extending upward therefrom. The tray 14 further includes a plurality of connectors 34 and alignment features 36 protruding upward. The connectors 34 extend through the connector openings 30 of the tub 12 to connect the tray 14 to the tub 12. The alignment features 36 extend through the alignment openings 32 to align the tub 12 to the tray 14.

Figure 2:
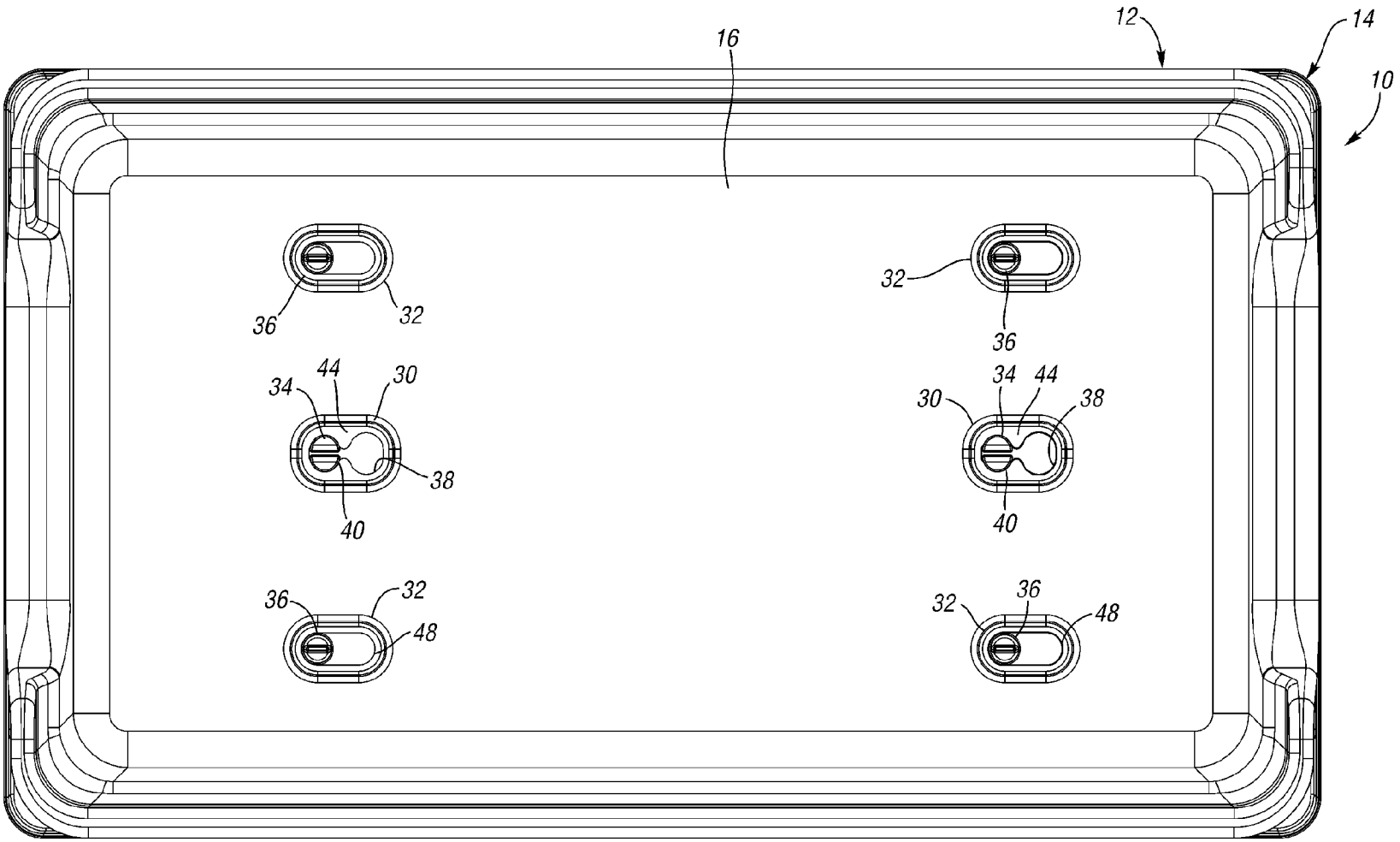
FIG. 2 is a top view of the tub and tray of FIG. 1.

FIG. 2 is a top view of the storage assembly 10 of FIG. 1. The connector openings 30 include a large portion 38 contiguous with a small portion 40. The large portion 38 and the small portion 40 are both defined by a flange 44, which is generally a portion of the bottom wall 16 having reduced thickness. The alignment openings 32 also are defined by a flange 48, which is generally a portion of the bottom wall 16 having reduced thickness.

Figure 3:
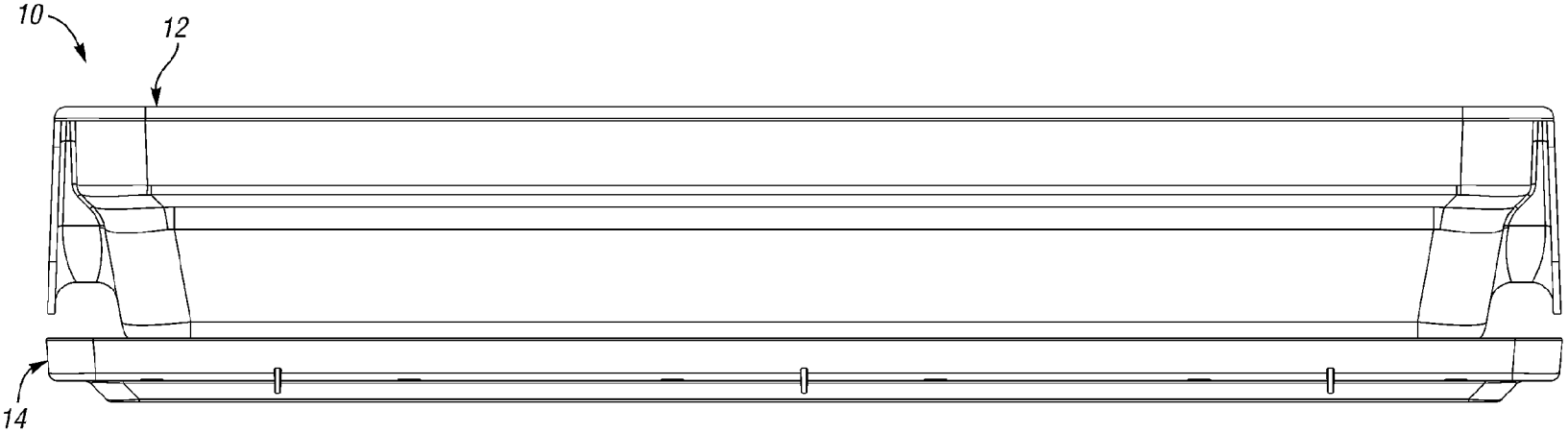
FIG. 3 is a side view of the tub and tray.
Figure 4:
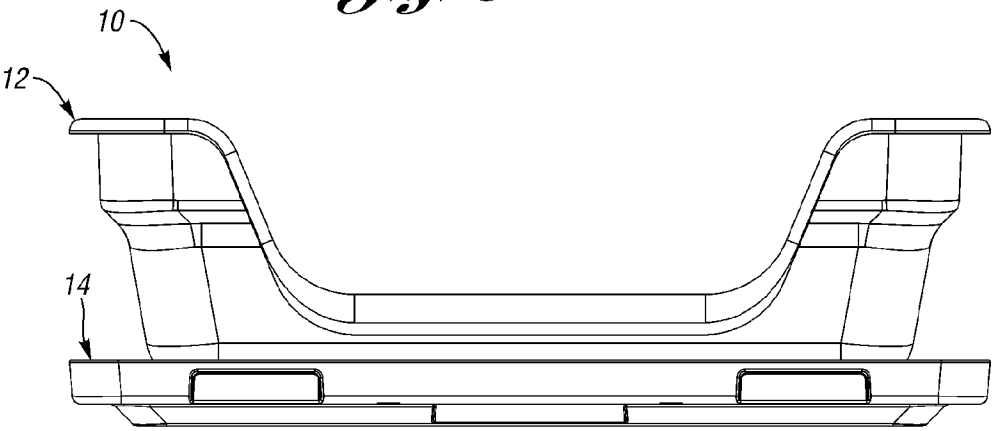
FIG. 4 is a front view of the tub and tray.

FIG. 3 is a side view of the tub 12 and tray 14. FIG. 4 is a front view of the tub 12 and tray 14. Preferably, if the tub 12 and tray 14 are to be used in a storage system, the tub 12 does not extend past the edges of the tray 14.

Figure 5:
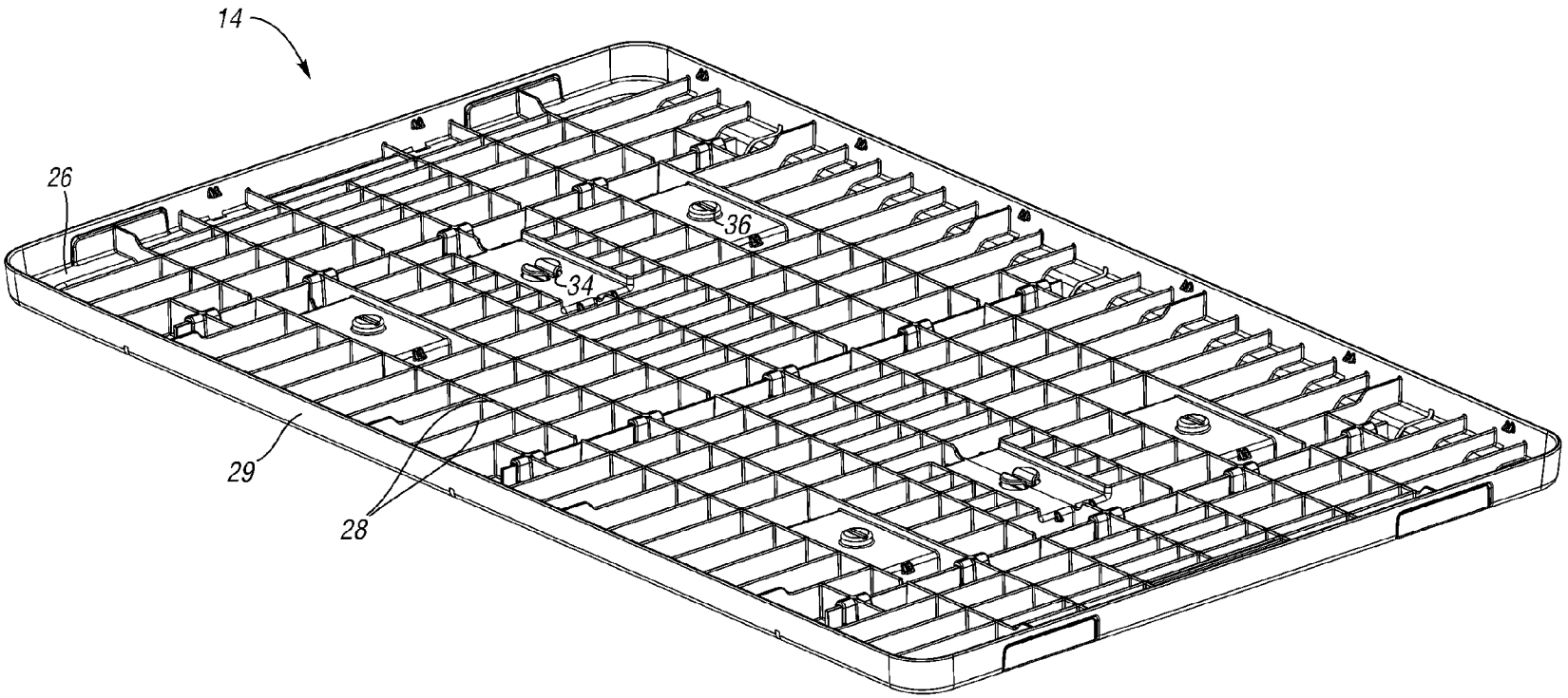
FIG. 5 is a perspective view of the tray of FIG. 1.
Figure 6:
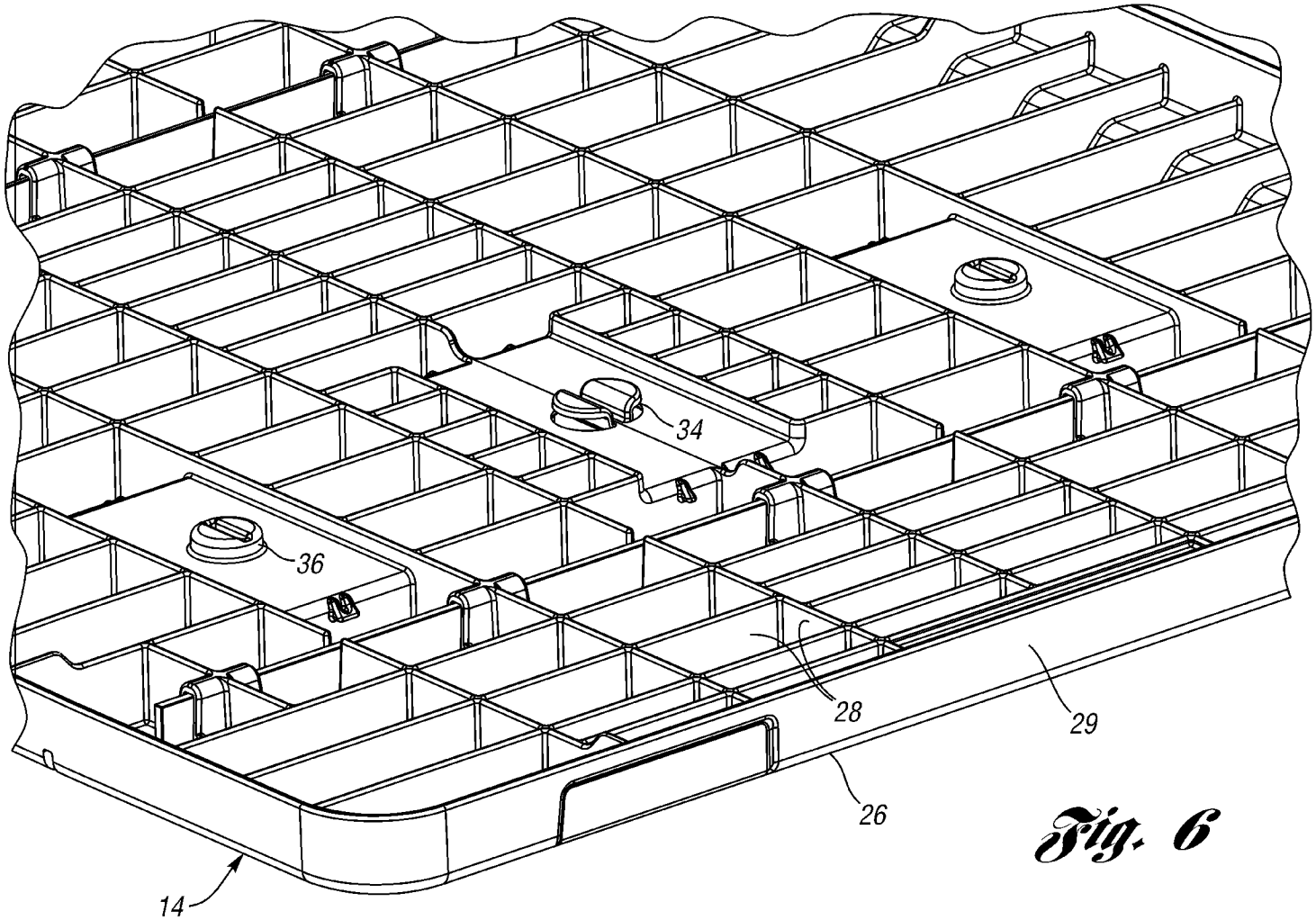
FIG. 6 is an enlarged view of a portion of the upper surface of the tray of FIG. 5.

FIG. 5 is a perspective view of the tray 14, which can be used independently of the tub 12 (FIG. 1). The plurality of ribs 28 may be formed in a grid as shown or in other arrangements. The plurality of connectors 34 and alignment features 36 protruding upward from raised portions of the bottom wall 16, as shown more clearly in FIG. 6. The connectors 34 and alignment features 36 are equal in height to the ribs 28 to provide a generally planar upper surface. Alternatively, they may be recessed relative to the plurality of ribs 28 as shown, or could have greater height than the ribs 28. The ribs 28 preferably extend upward from the bottom wall 16 as shown, so that a smooth bottom surface is provided which is better suited for sliding along surfaces in the storage and retrieval system. Alternatively, however, the ribs 28 could extend downward from the wall to provide a smooth upper surface. As another alternative, a wall could be welded to outer ends of the ribs 28, whether extending upwardly or downwardly, in order to provide smooth upper and lower surfaces and added strength.

Figure 7:
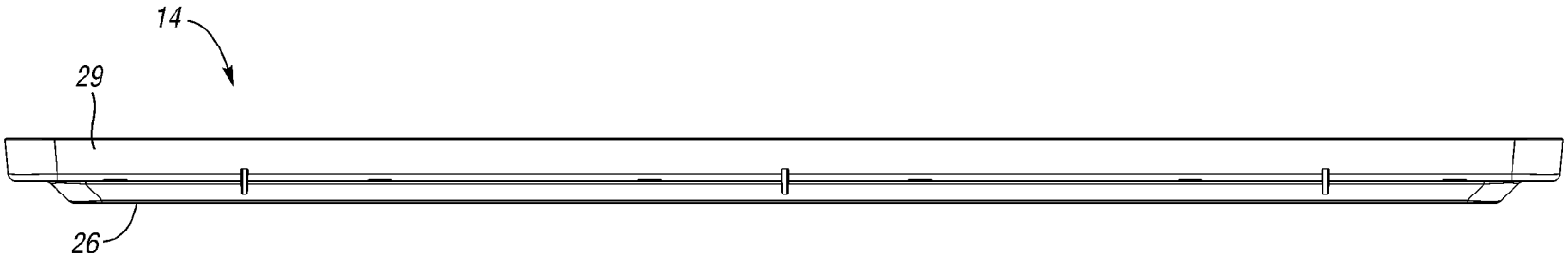
FIG. 7 is a side view of the tray.
Figure 8:
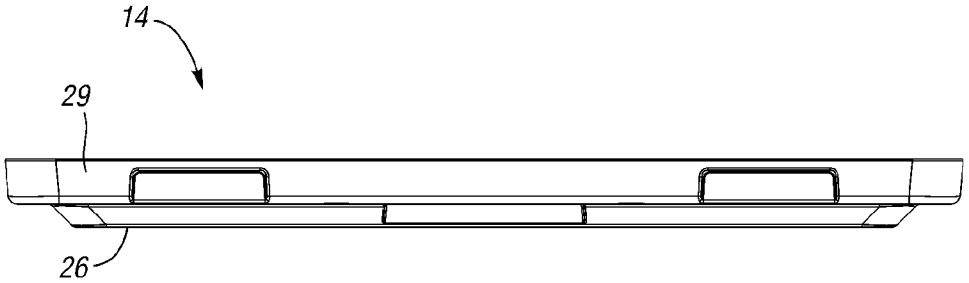
FIG. 8 is a front view of the tray.

FIG. 7 is a side view of the tray 14. FIG. 8 is a front view of the tray 14.

Figure 9:
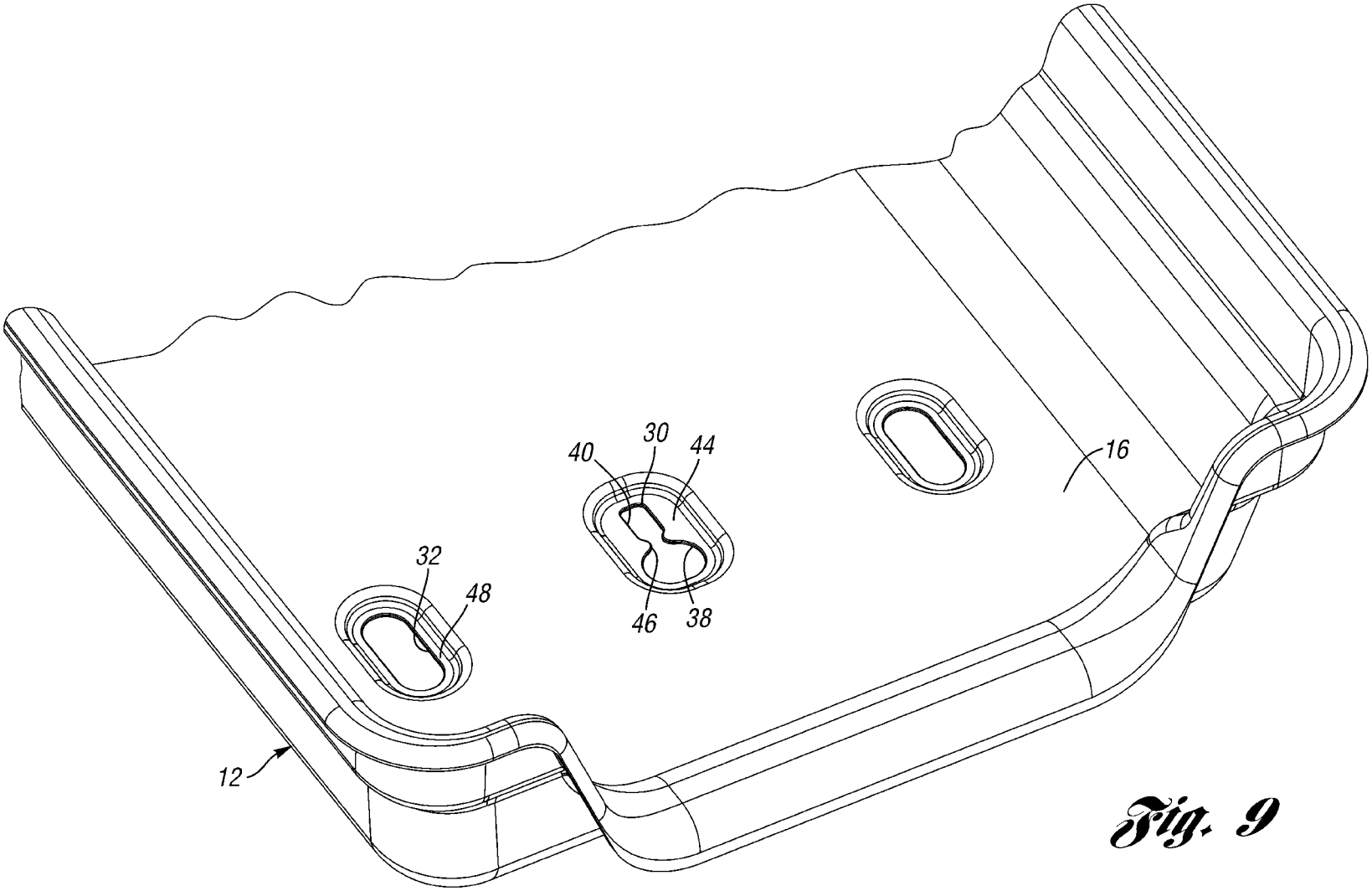
FIG. 9 is an enlarged perspective view of a portion of the tub of FIG. 1.

FIG. 9 is an enlarged perspective view of a portion of the tub 12 of FIG. 1, illustrating one of the connector openings 30 and two of the alignment openings 32. The flange 44 of the connector opening 30 includes a neck 46 between the large portion 38 and the small portion 40, reducing the dimension of the connector opening 30 below that of the small portion 40.

Figure 10:
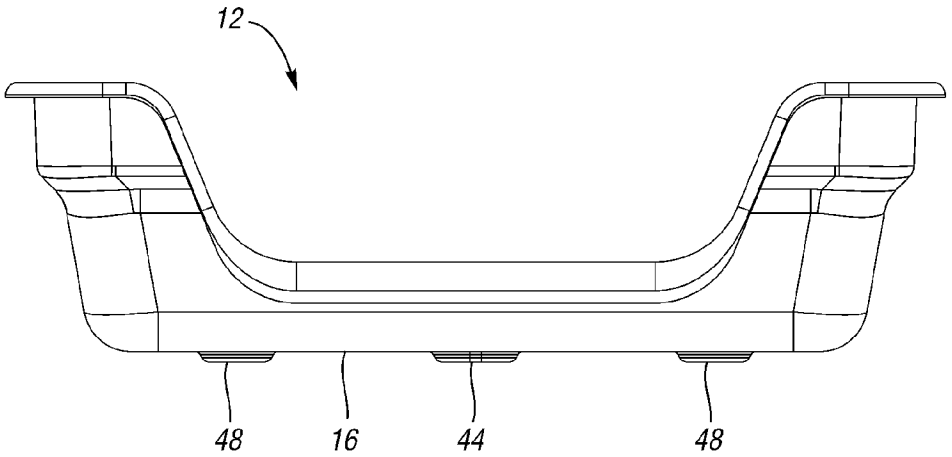
FIG. 10 is a front view of the tub.
Figure 11:
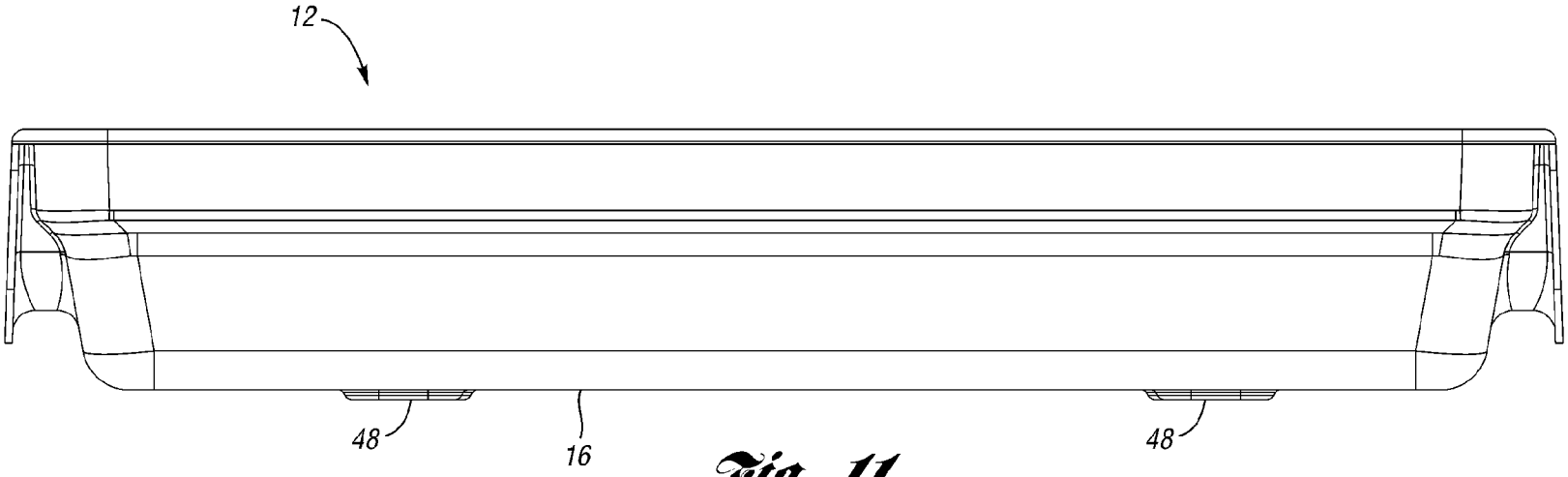
FIG. 11 is a side view of the tub.

The flanges 44, 48 of the connector openings 30, 32 preferably protrude downward from the bottom wall 16, as shown in FIGS. 10 and 11, although this is not required.

Figure 12:
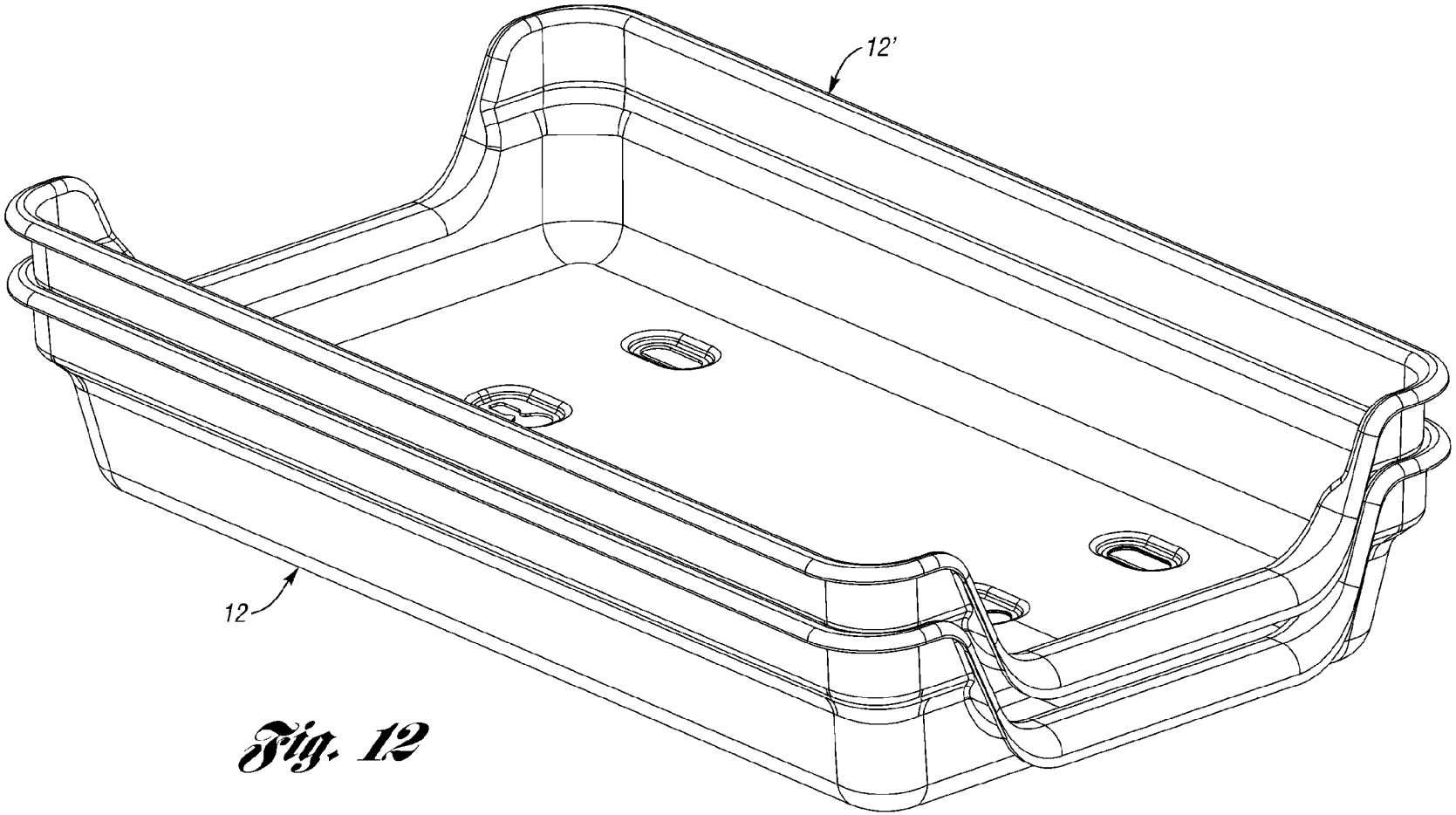
FIG. 12 is a perspective view of the tub of FIG. 1 having a similar tub nested therein.
Figure 13:
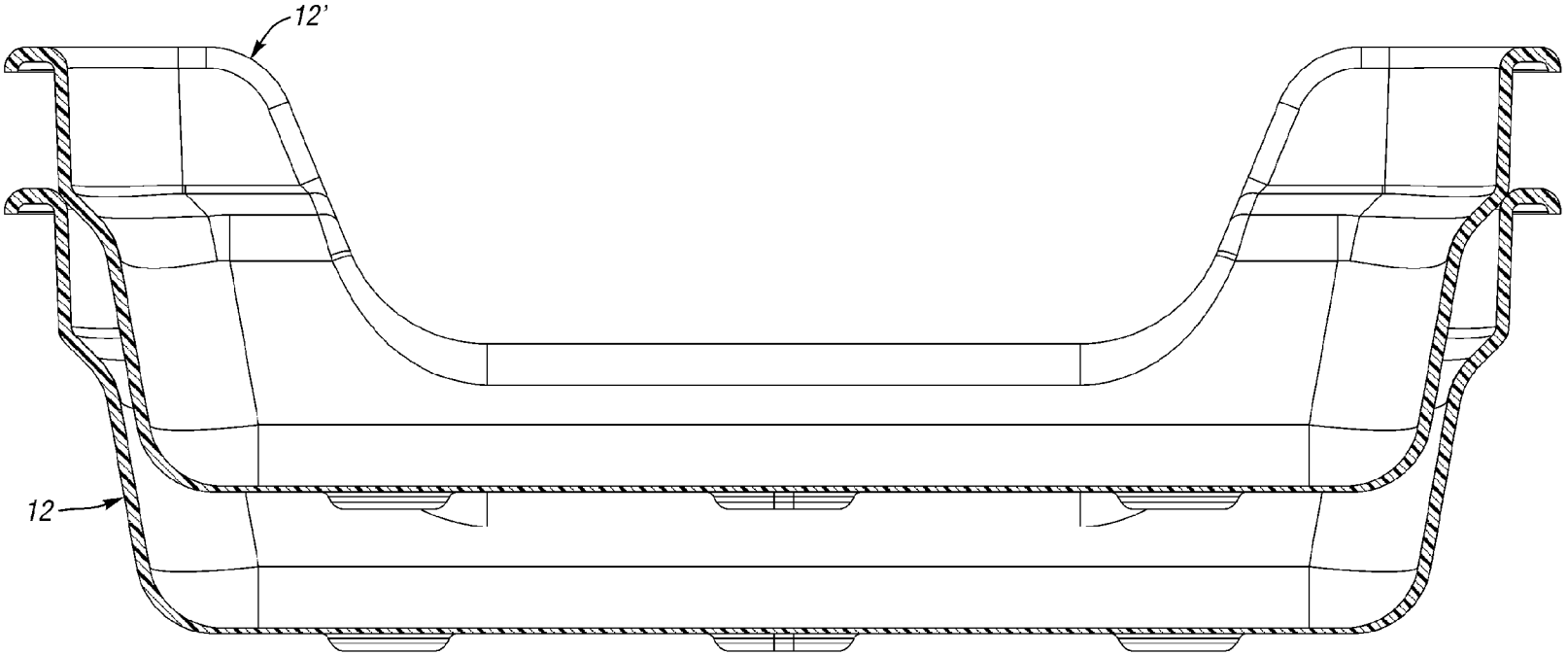
FIG. 13 is a section view of the tubs of FIG. 12.

The walls 18, 20 of the tub 12 are tapered down to the bottom wall 16, such that a similar tub 12' can be nested within the tub 12 when empty, as shown in FIGS. 12 and 13. This facilitates storage and shipping when empty.

Figure 14:
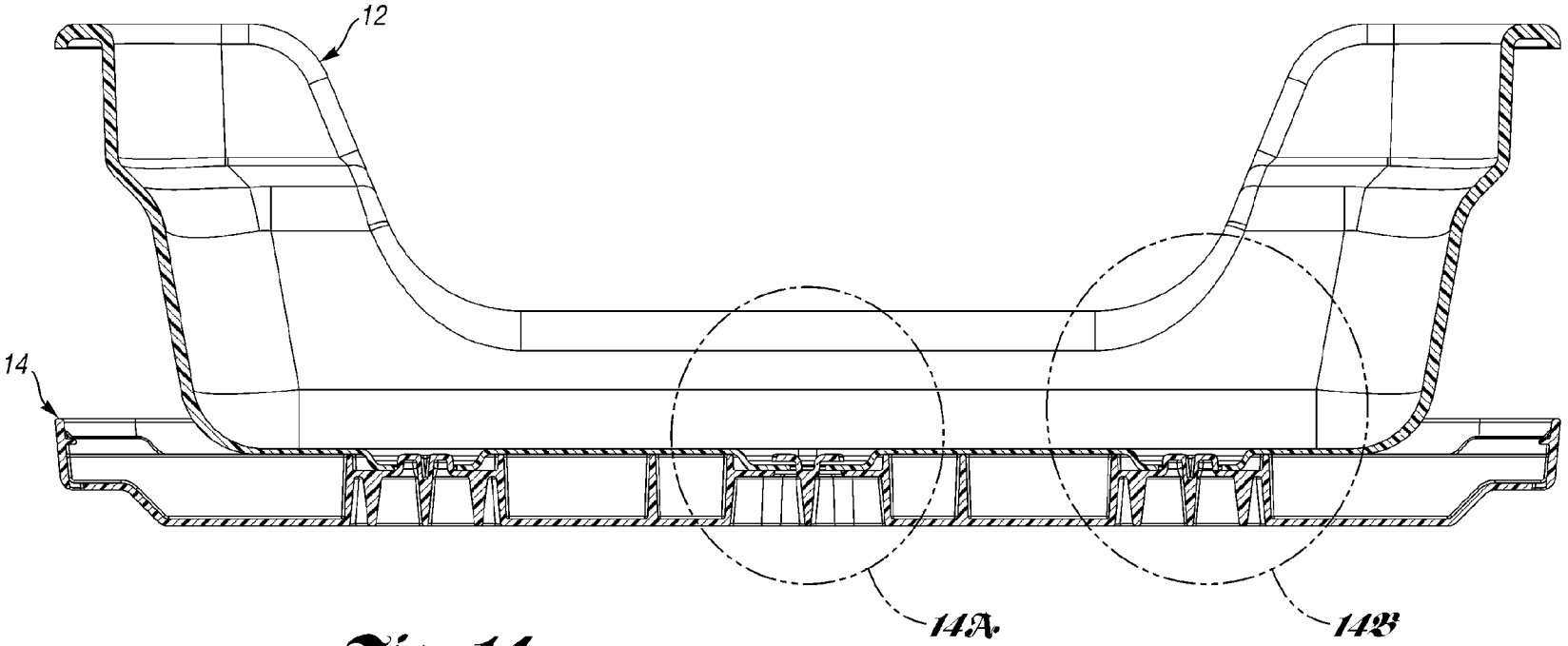
FIG. 14 is a section view through the tub and tray of FIG. 1.
Figure 14A:
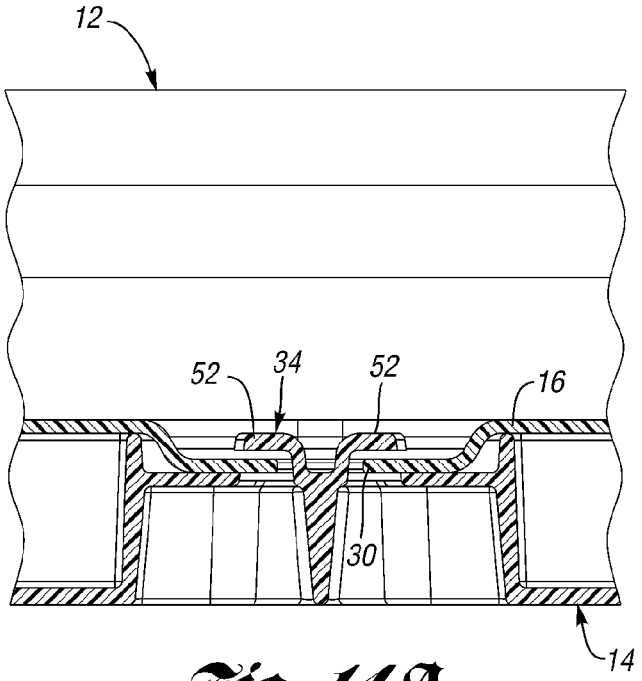
FIG. 14A is an enlarged view of Area A of FIG. 14.

FIG. 14 is a section view through the tub 12 and tray 14 of FIG. 1. FIG. 14A is an enlarged view of Area A of FIG. 14. The connector 34 has wings 52 protruding in opposite directions from its outer end. The wings 52 are larger than the small portion 40 of the connector opening 30, but smaller than the large portion 38. For assembly, the connector 34 is inserted through the large portion 38. The tub 12 is then slid relative to the tray 14 so that the connector 34 is slid into the small portion 40 and the wings 52 of the connector 34 are interlocked over the flange 44, thereby retaining the tub 12 to the tray 14.

Figure 14B:
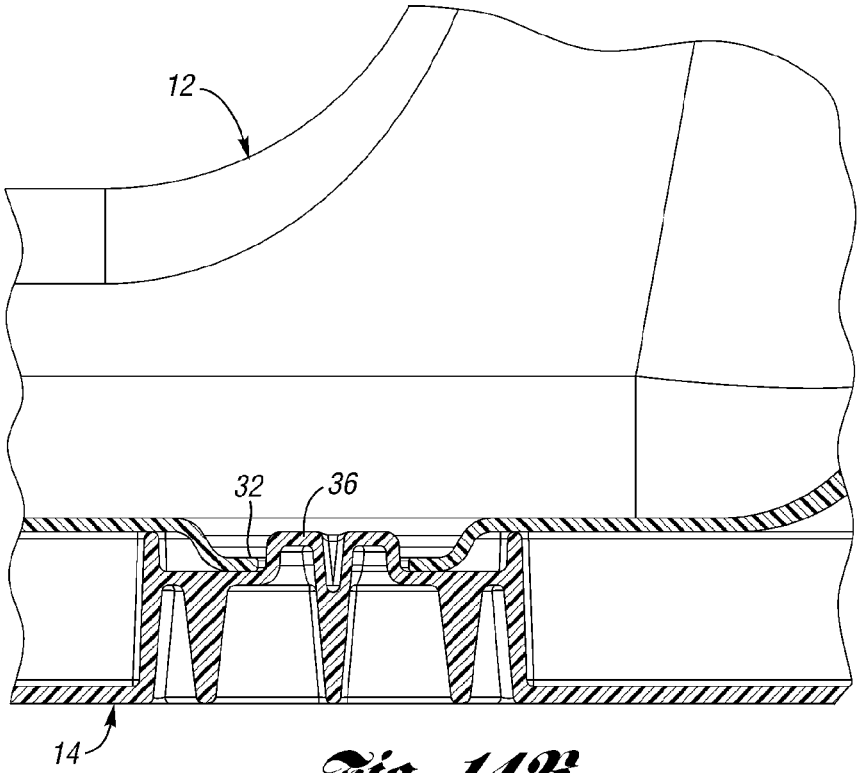
FIG. 14B is an enlarged view of Area B of FIG. 14.

FIG. 14B is an enlarged view of Area B of FIG. 14, showing the engagement of the alignment feature 36 in the alignment opening 32. The alignment feature 36 can slide within the elongated alignment opening 32 as the tub 12 is slid relative to the tray 14. The alignment feature 36 and alignment openings 32 align the tub 12 with the tray 14.

Figure 15:
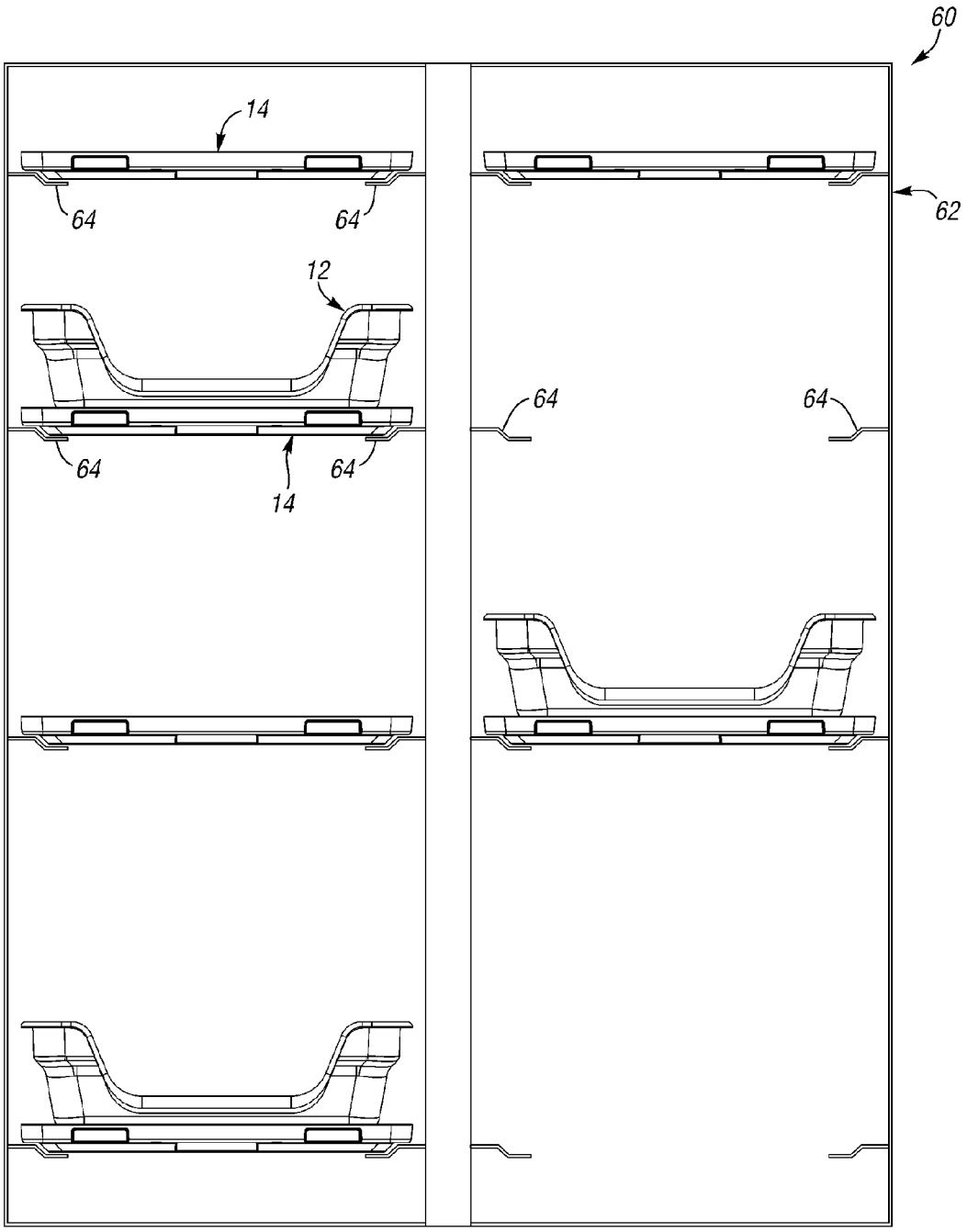
FIG. 15 is a front view of a storage system including a plurality of the tubs and trays of FIG. 1.

FIG. 15 is a side view of a storage system 60 including a rack 62 having a plurality of pairs of spaced apart supports or rails 64. The pairs of rails 64 are arranged in rows and columns. The trays 14 are sized to be supported at opposite sides of the tray 14 by the rails 64. The trays 14 can be used alone for storing objects, particularly boxed or larger objects, in the rack 62. Unboxed smaller objects can be placed in tub 12 and tray 14 assemblies. The tub 12 and tray 14 assemblies are supported by the rails 64 by the trays 14. Because the tray 14 is reinforced sufficiently to support the weight, the tubs 12 need not be reinforced, but can be molded with a single-wall thickness, such as by injection molding, thermoforming, compression molding, rotational molding or other suitable processes. This reduces the cost and weight of the tubs 12. In particular, since the tubs 12 can have a single-wall thickness without reinforcement ribs, they can be produced economically in low volumes via thermoforming.

The trays 14 may be formed by injection molding or other suitable process that provides sufficient strength for the trays 14 to be supported at opposite sides by the rails 64. The storage system 60 can be part of an automated storage and retrieval system, where the trays 14 are handled by automated storage and retrieval equipment. The equipment can be adapted to handle the trays 14 in a similar manner, whether or not the trays 14 have tubs 12 secured thereto.

Figure 16:
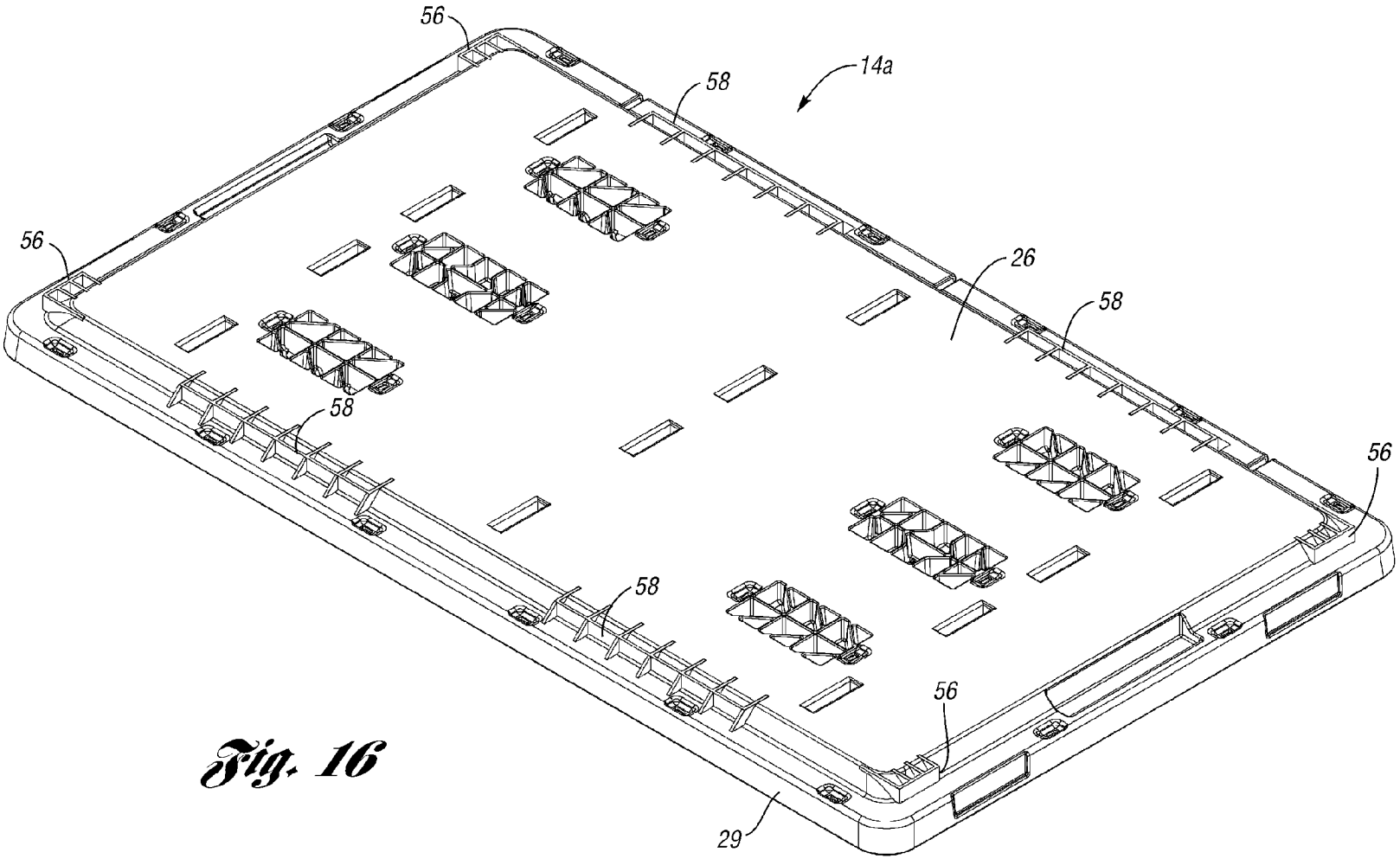
FIG. 16 is a bottom perspective view of an alternate tray.

FIG. 16 is a bottom perspective view of an alternate tray 14*a*, which is identical to the tray 14 in the previous Figures except for two additional features. First, the tray 14*a* further includes ribs forming end stops 56 at the front and rear ends of the tray 14*a*. The end stops 56 provide generally perpendicular surfaces for engaging with complementary stops formed at the front and rear ends of the rails 64. This prevents the trays 14a from sliding off the front or rear of the rails 64. The tray 14*a* further includes side ribs 58, which simply adjust the fit of the tray 14*a* on the rails 64. The inclusion of the side ribs 58 and the size of the side ribs 58 depends upon the particular rails 64 with which the tray 14*a* is to be used.

Figure 17:
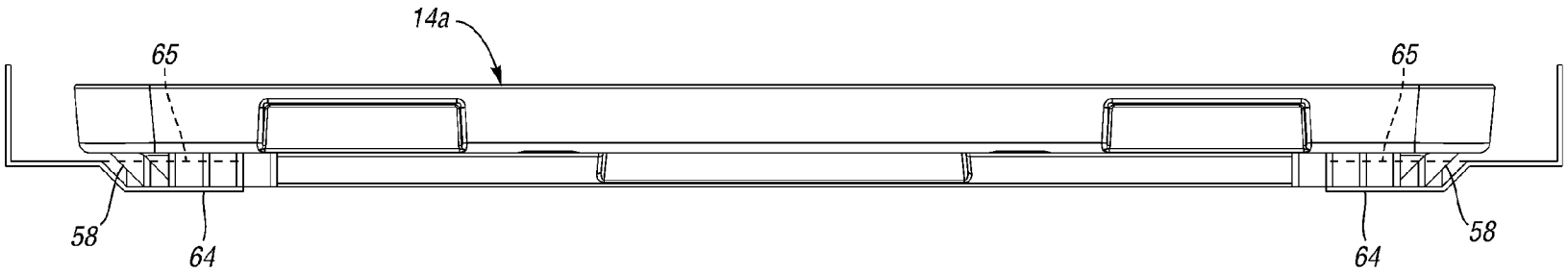
FIG. 17 is a front view, partially broken away, of the tray of FIG. 16 on supports similar to the supports of FIG. 15.

FIG. 17 is a front view, partially broken away, of the tray 14*a* of FIG. 16 on supports 64*a* similar to those of FIG. 15, with the further inclusion of end stops 65, which engage the end stops 56 on the tray 14*a* to prevent the tray 14*a* from sliding off the front and rear of the rails 64*a*.

Although the examples above illustrate molded-in connectors for securing the tray 14 to the tub 12, separate connectors, such as a bolt, wire tie, post and cotter pin, etc. could also be used. The tray 14 could include different types of reinforcement members instead of or in addition to the ribs 28. For example, the tray 14 could be twin-sheet thermoformed and include steel inserts for reinforcement members.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A tub and tray assembly comprising:

a tray including a plurality of reinforcement members including support ribs that extend upward from a bottom wall of the tray; and a tub removably secured to the tray, the tub including a pair of opposed first walls extending upward from a bottom wall, a portion of the bottom wall of the tub between the first walls supported on and contacting outer, free ends of the plurality of support ribs, the tub further including a second wall that is significantly shorter than the first walls.

2. The tub and tray assembly of claim 1 wherein the tray includes a connector protruding upward from the tray.

3. The tub and tray assembly of claim 2 wherein the tub includes a connector complementary to the connector on the tray.

4. The tub and tray assembly of claim 3 wherein the connector on the tray is recessed relative to the support ribs.

5. The tub and tray assembly of claim 4 wherein the tub further includes a lip protruding outwardly from an upper edge of the first walls and the second wall.

6. The tub and tray assembly of claim 5 wherein the tub is thermoformed.

7. The tub and tray assembly of claim 4 wherein the connector on the tub protrudes downward from the bottom wall.

8. The tub and tray assembly of claim 7 wherein the connector on the tub includes an opening through the bottom wall.

9. The tub and tray assembly of claim 8 wherein the opening includes a large portion and a small portion, the large portion larger than the connector on the tray, the small portion smaller than the connector on the tray.

10. The tub and tray assembly of claim 3 wherein the bottom wall is between the connector and a lower portion of the tray below the bottom wall.

11. The tub and tray assembly of claim 1 wherein the tub includes a single bottom wall without ribs.

12. The tub and tray assembly of claim 1 wherein the portion of the bottom wall of the tub is a single wall without ribs.

13. The tub and tray assembly of claim 12 wherein the support ribs on which the portion of the bottom wall is supported are a plurality of intersecting ribs extending upward from the bottom wall of the tray.

14. The tub and tray assembly of claim 13 wherein the bottom wall of the tray is the bottom most surface of the tub and tray assembly.

15. A method for making a storage system including the steps of:

a) thermoforming a tub having a bottom wall and a pair of opposed walls;

b) forming a tray having a plurality of reinforcement members and at least one connector adapted to removably connect the tray to the tub; and c) removably securing the tub to the tray via the at least one connector such that a portion of the connector is above the bottom wall and such that a portion of the bottom wall is between the portion of the connector and a lower portion of the tray below the bottom wall.

16. The method of claim 15 wherein said step a) includes the step of forming the bottom wall without ribs.

17. The method of claim 16 wherein said step a) further includes the step of forming at least one opening through the bottom wall, the at least one opening adapted to connect to the at least one connector of the tray.

* * * * *